US006071160A

United States Patent [19]

Chen

[11] Patent Number: 6,071,160

[45] Date of Patent: Jun. 6, 2000

[54] SURFBOARD HAVING EMBEDDED REINFORCING MESH

[75] Inventor: Ching Hsi Chen, Chang Hua Hsien, Taiwan

[73] Assignee: Sun Own Industrial Co., Ltd., Taiwan

[21] Appl. No.: 09/093,977

[22] Filed: Jun. 9, 1998

[51] Int. Cl.[7] ..... B63B 35/79

[52] U.S. Cl. ..... 441/74; 114/357

[58] Field of Search ..... 114/39.12, 357; 441/65, 74

[56] References Cited

U.S. PATENT DOCUMENTS 5,114,370 5/1992 Moran ..... 441/74

5,797,779 8/1998 Stewart ..... 441/74

5,851,462 12/1998 Chen ..... 264/55

*Primary Examiner*—Stephen Avila

*Attorney, Agent, or Firm*—Dougherty & Troxell

[57] ABSTRACT

A surfboard includes a board and a plate secured to the bottom of the board and formed by a foamable material. A reinforcing mesh is embedded in the plate and includes a number of mesh openings. The material for forming the plate is engaged into the mesh openings for allowing the reinforcing mesh to be solidly embedded in the plate and for greatly increasing the strength of the surfboard. The reinforcing mesh may be embedded in the lower portion of the plate or may includes a thickness equals to that of the plate or greater than that of the plate.

4 Claims, 3 Drawing Sheets

SURFBOARD HAVING EMBEDDED REINFORCING MESH

BACKGROUND OF THE INVENTION

1. Field of the Invention

The present invention relates to a surfboard, and more particularly to a surfboard having a reinforcing mesh layer solidly embedded in the board body.

2. Description of the Prior Art

Typical surfboards comprise a number of layers secured together by such as adhesive materials, so as to form the surfboard. However, the number of layers are normally secured together by adhesive materials such that the number of layers may be easily disengaged from each other after use.

The present invention has arisen to mitigate and/or obviate the afore-described disadvantages of the conventional surfboards.

SUMMARY OF THE INVENTION

The primary objective of the present invention is to provide a surfboard which includes a reinforcing mesh layer solidly embedded in the board body for greatly increasing the strength of the surfboard.

In accordance with one aspect of the invention, there is provided a surfboard comprising a body including a bottom portion, a plate secured to the bottom portion of the body and formed by a material, and a reinforcing mesh embedded in the plate and including a plurality of mesh openings, the material for forming the plate being engaged into the mesh openings for allowing the reinforcing mesh to be solidly embedded in the plate.

The plate includes a lower portion, the reinforcing mesh is embedded in the lower portion of the plate. The reinforcing mesh includes a thickness equals to that of the plate, for allowing the material for forming the plate to be filled in the mesh openings of the reinforcing mesh.

The reinforcing mesh includes a thickness greater than that of the plate and includes an upper portion engaged into and embedded in the body. The reinforcing mesh may also include a lower portion extended downward and outward of the plate.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
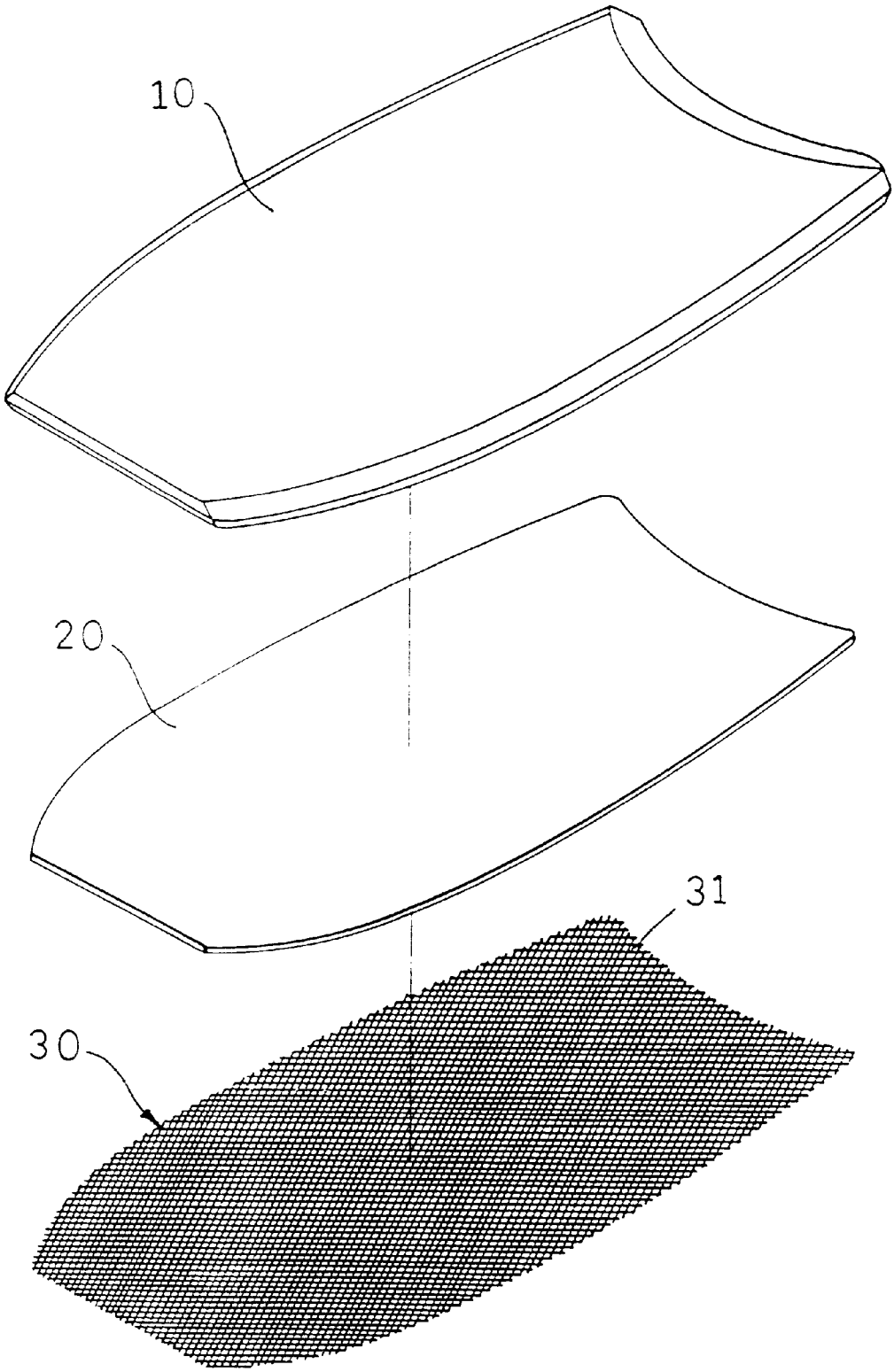
FIG. 1 is an exploded view of a surfboard in accordance with the present invention.
Figure 2:
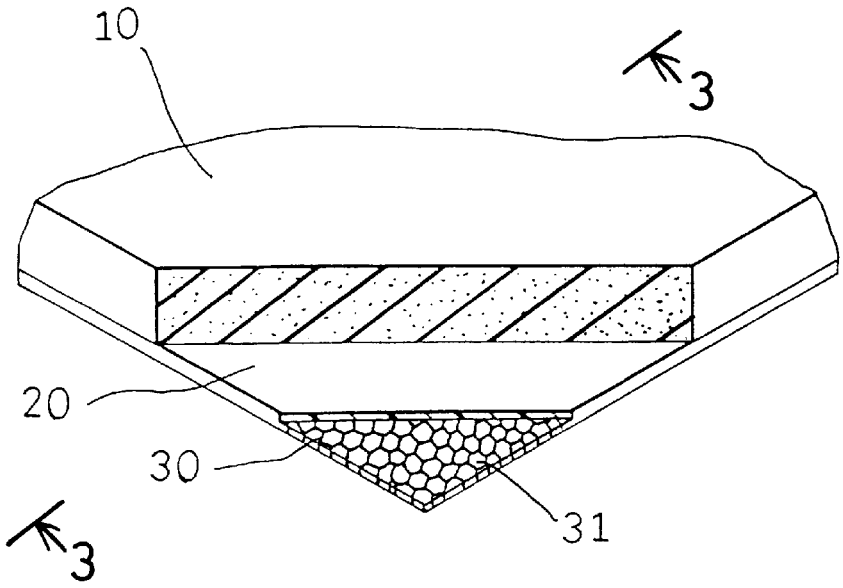
FIG. 2 is a partial perspective view of the surfboard, in which a portion of the surfboard is cut off for showing the inner structure of the surfboard.
Figure 3:
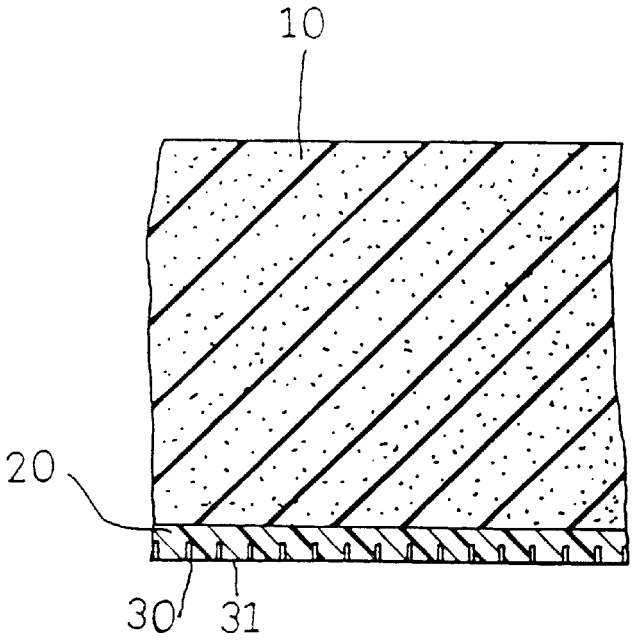
FIG. 3 is a cross sectional view taken along lines 3—3 of FIG. 2.

Referring to the drawings, and initially to FIGS. 1–3, a surfboard comprises a board body 10 of foamable materials, such as ethylene vinyl acetate copolymer (EVA), polyethylene (PE), or the mixture thereof. A plate 20 is secured to the bottom of the body 10 and is made of stiffing material, such as ethylene vinyl acetate copolymer (EVA), polyethylene (PE), or the mixture thereof, which includes a greater stiffness than that of the body 10. A reinforcing mesh 30 is to be embedded in the plate 20 and includes a number of mesh openings 31. The mesh 30 is preferably a woven member formed by plastic or fibers.

For embedding the mesh 30 in the plate 20, the plate 20 and the mesh 30 and/or the body 10 are disposed in and hot-pressed by a mold device. The plate 20 and/or the body 10 will be melted when they are heated, such that the mesh 30 may be embedded in the plate 20 after the plate 20 is melted and such that the material for forming the plate 20 (in fluid or melted status) may be engaged into the mesh openings 31 (FIG. 3), such that the mesh 30 may be solidly embedded in the plate 20 without additional adhesive materials.

The mesh 30 that is embedded in the plate 20 may greatly increase the strength and the flexibility of the board and may prevent the board from being easily broken. The mesh material 30 includes a weight no greater than that of the plate 20, such that the strength of the plate 20 may be increased without increasing its weight. The body 10 and the plate 20 may also be solidly secured together during the hot-pressing process without any additional adhesive materials, such that the body 10 and the plate 20 may be taken as an integral board body.

Figure 4:
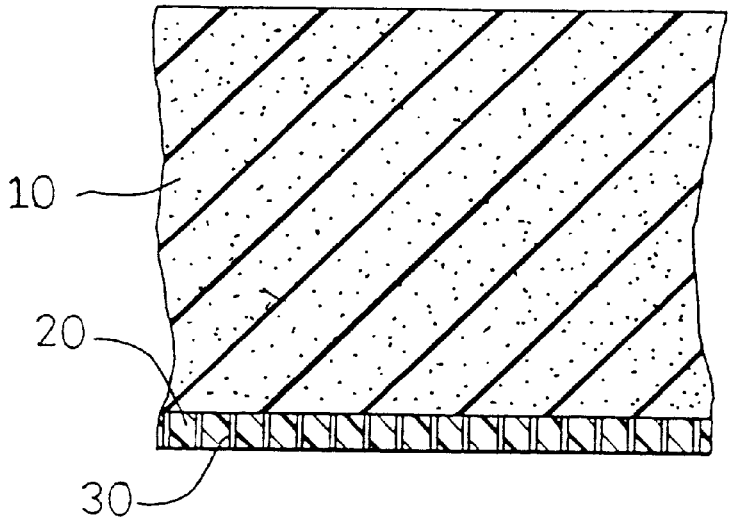
FIGS. 4 and 5 are cross sectional views similar to FIG. 3, illustrating the other applications of the surfboard.
Figure 5:
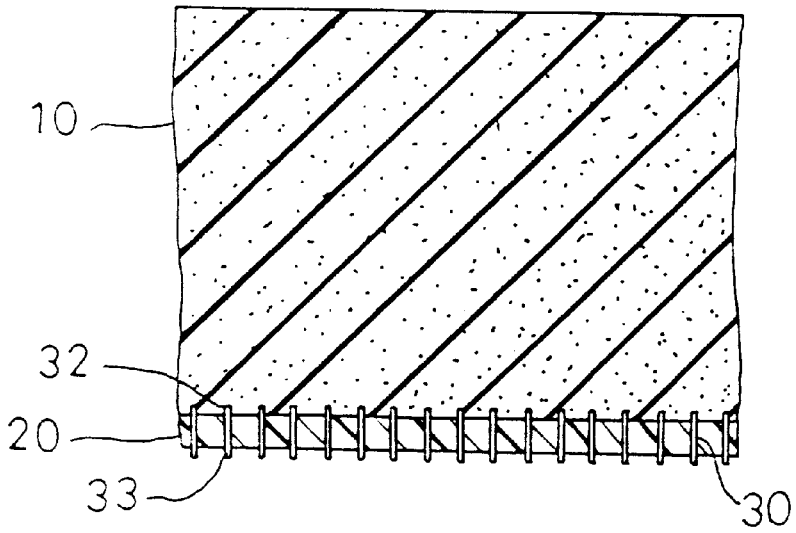

The mesh 30 includes a thickness equals to that of the plate 20 (FIG. 4) or greater than that of the plate 30 (FIG. 5) in which the mesh 30 includes an upper portion 32 engaged into and embedded in the body 10 and a lower portion 33 extended outward of the plate 20 for forming a coarse bottom to the plate 20 and for increasing the maneuverability of the surfboard.

Accordingly, the surfboard includes a reinforcing mesh solidly embedded in the board body for greatly increasing the strength of the surfboard.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

What is claimed is:

1. A surfboard comprising:

a body including a bottom portion;

a plate secured to said bottom portion of said body and formed by a material; and, a reinforcing mesh embedded in said plate and including a plurality of mesh openings, said material forming said plate being engaged into said mesh openings thereby solidly embedding said reinforcing mesh in said plate, wherein said reinforcing mesh includes a thickness equal to that of said plate, for allowing the material forming said plate to be filled in said mesh openings of said reinforcing mesh.

2. The surfboard according to claim 1, wherein said plate includes a lower portion, and said reinforcing mesh is embedded in said lower portion of said plate.

3. A surfboard comprising:

a body including a bottom portion;

a plate secured to said bottom portion of said body and formed by a material; and, a reinforcing mesh embedded in said plate and including a plurality of mesh openings, said material forming said plate being engaged into said mesh openings thereby solidly embedding said reinforcing mesh in said plate, wherein said reinforcing mesh includes a thickness greater than that of said plate and includes an upper portion engaged into and embedded in said body.

4. A surfboard comprising:

a body including a bottom portion;

a plate secured to said bottom portion of said body and formed by a material; and, a reinforcing mesh embedded in said plate and including a plurality of mesh openings, said material for forming said plate being engaged into said mesh openings thereby solidly embedding said reinforcing mesh in said plate, wherein said reinforcing mesh includes a thickness greater than that of said plate and includes a lower portion extending downwardly and outwardly of said plate.

* * * * *